US005433325A

United States Patent [19]

Levaro et al.

[11] Patent Number: 5,433,325

[45] Date of Patent: Jul. 18, 1995

[54] MAIL ACCUMULATING DEVICE

[75] Inventors: Mauro Levaro; Vincenzo Priolo, both of Genoa, Italy

[73] Assignee: Finmeccanica S.p.A., Rome, Italy

[21] Appl. No.: 158,339

[22] Filed: Nov. 29, 1993

[51] Int. Cl.[6] ..... B07C 5/00; B65H 5/22

[52] U.S. Cl. ..... 209/584; 209/900; 271/3.13; 271/216

[58] Field of Search ..... 209/576, 583, 584, 900, 209/656; 271/3.1, 176, 216, 290, 297, 298, 299, 301

[56] References Cited

U.S. PATENT DOCUMENTS

| | | | |
|---|---|---|---|
| 4,388,994 | 6/1983 | Suda et al. | 209/900 X |
| 4,921,109 | 5/1990 | Hasuo et al. | 209/900 X |
| 5,119,954 | 6/1992 | Svyatsky et al. | 271/3.1 X |
| 5,143,225 | 9/1992 | Rabindran et al. | 271/216 X |
| 5,152,512 | 10/1992 | Yoshida et al. | 271/3.1 |

FOREIGN PATENT DOCUMENTS

| | | | |
|---|---|---|---|
| 429118A1 | 5/1991 | European Pat. Off. . | |
| 552778A2 | 7/1993 | European Pat. Off. . | |
| 566456 | 10/1993 | European Pat. Off. | 209/584 |
| 2440785 | 6/1980 | France . | |
| 1277606 | 9/1968 | Germany . | |
| 1623798 | 1/1991 | U.S.S.R. | 209/584 |

*Primary Examiner*—William E. Terrell
*Assistant Examiner*—Tuan N. Nguyen
*Attorney, Agent, or Firm*—Shlesinger, Arkwright & Garvey

[57] ABSTRACT

An accumulating device having ten accumulating units connected at the input to a conveyor belt system and designed to house a number of mail items. Each accumulating unit comprises a conveyor system composed of two belts contacting each other along a substantially straight portion and having a sensor for generating an enabling signal upon a mail item being fed into the accumulating unit. As a consequence of the enabling signal, the belts are shifted one discrete step so that the mail items fed into the accumulating unit are inserted between the two belts and overlap one another.

14 Claims, 3 Drawing Sheets

MAIL ACCUMULATING DEVICE

BACKGROUND OF THE INVENTION

The present invention relates to a mail accumulating device.

Postal machines are known featuring at least one accumulating device (stacker) comprising a number of accumulating units (pockets) for housing mail items (letters and postcards) fed to the accumulating device by a supply system output-connected to the accumulating units and supplied with mail items by a sorting device (e.g. a code reader).

The mail items form a substantially orderly pile of letters and postcards inside the accumulating units, and are withdrawn manually by an operator or automatically by an unloading robot when the pile reaches a given height.

Unloading of the accumulating units takes a certain amount of time, thus slowing down the sorting process and impairing the efficiency of the machine as a whole.

SUMMARY OF THE INVENTION

It is an object of the present invention to provide an accumulating device wherein unloading of the accumulating units involves substantially no downtime.

According to the present invention, there is provided a mail accumulating device comprising:

at least two accumulating units, each designed to house a number of mail items;

a first conveyor system moving towards, and designed to feed said mail items into, said accumulating units; and a second conveyor system for receiving the mail items at the output of said accumulating units;

characterized by the fact that said accumulating units comprise conveyor means moved by drive means and designed to retain and feed said mail items along a path extending between the input and output of said units; each said accumulating unit also comprising first sensor means for detecting entry of a mail item into the unit, and for generating a first signal for enabling said drive means;

said conveyor means moving the mail items in said unit from said input to said output in discrete steps effected for each enabling signal generated by said sensor means, so as to form a group of mail items aligned along said conveyor means and overlapping one another.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
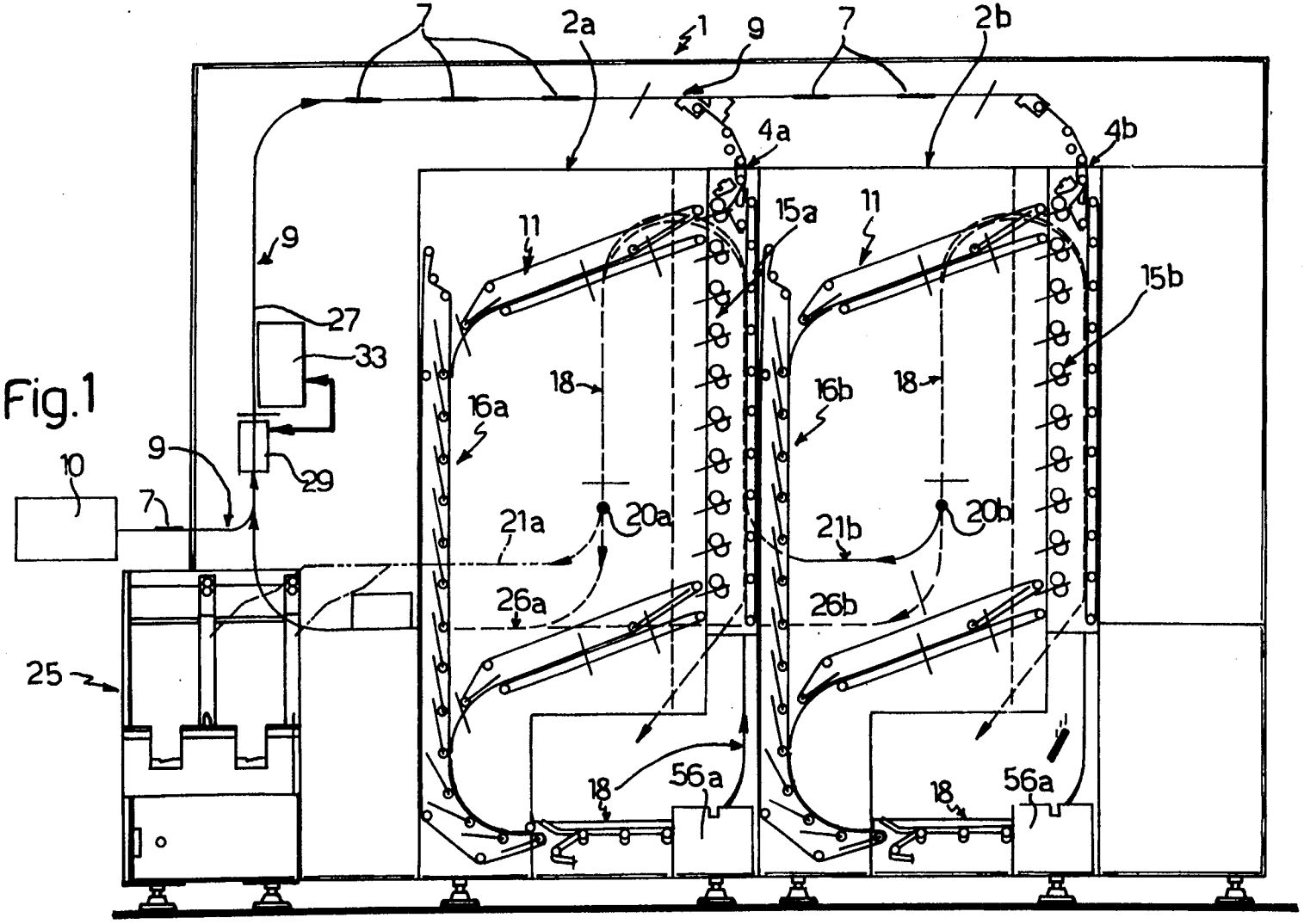
FIG. 1 shows a simplified, partially schematic front view of a postal machine featuring two accumulating devices in accordance with the teachings of the present invention.

Number 1 in FIG. 1 indicates a postal machine comprising two identical accumulating devices *2a, 2b* supplied at respective inputs *4a, 4b* with a number of rectangular mail items 7 (letters and postcards) by a conveyor belt system 9 (shown schematically in FIG. 1) input-connected to a postal machine 10 (shown schematically), e.g. a mail separating machine for withdrawing items 7 from a pack (not shown) and arranging them on conveyor belt system 9.

Each accumulating device *2a, 2b* presents ten accumulating units 11 input-connected to input *4a, 4b* by a conveyor and switch system *15a, 15b*, and designed to receive and house mail items 7 as described in detail later on. Accumulating units 11 of each device *2a, 2b* are all output-connected to a collecting and conveyor system *16a, 16b* contained in device *2a, 2b* and joining up with an external conveyor belt system *18a, 18b* (the end portion of which is shown by the dotted line) extending between device *2a, 2b* and a junction *20a, 20b* where conveyor system *18a, 18b* branches off into a conveyor portion *21a, 21b*, which joins up with an end processing device 25 (e.g. a unit for stacking mail items 7), and a second conveyor portion *26a, 26b* by which mail items 7 are fed to conveyor system 9.

Conveyor system 9 also comprises a straight conveyor portion 27 extending downstream from the point at which portions *26a, 26b* join up with conveyor system 9, and which is connected to an optoelectronic reading unit 29 for reading the identification code, e.g. the postal code, of mail items 7. Reading unit 29 is connected to a central microprocessor unit 33 (shown schematically) for controlling all the operations performed by postal machine i and accumulating devices *2a, 2b*.

A detailed description of accumulating devices *2a, 2b* will now be given with special reference to FIG. 2. As both devices *2a, 2b* present the same internal structure and operate in exactly the same way, in the following description, the subscripts of the numbers indicating the various parts of the devices will be omitted.

Each accumulating device 2 comprises a substantially parallelepiped vertical supporting structure 40 having a flat front wall consisting of two flat metal plates 43 and 44 adjacent to each other and of which plate 43 supports conveyor and switch system 15, and plate 44 accumulating units 11 and collecting and conveyor system 16.

In particular, accumulating units 11 are fitted in projecting manner to plate 44, are equally spaced one over the other, and present respective inputs 50 communicating with conveyor system 15.

Conveyor and switch system 15 comprises a vertical conveyor belt 47 fitted to plate 43 and extending parallel to the vertical edge 48 of structure 40; and ten switch devices 49 (only one shown for the sake of simplicity) equally spaced along belt 47 and located at the respective inputs 50 of units 11.

In particular, belt 47 extends between a roller 53 in a top portion of plate 43 and a bottom drive roller 54, and is supported on a number of equally spaced, vertically aligned idle rollers 56. Conveyor system 15 is also connected to a recovery device consisting of a parallelepiped, open-topped container 56a housed in a bottom portion of supporting structure 40, located beneath roller 54 of conveyor belt 47, and which, as described later on, provides for housing mail items 7 not fed into accumulating units 11.

Each switch device 49 comprises a blade type selector device 57 to the side of belt 47; and a curved, downwardly convex blade 58 extending between a first end 58*a* adjacent to a bottom portion of selector 57, and a second end **58*b* facing input 50 of a respective unit 11**.

Switch device 49 also comprises a pair of rollers 60, 61 close to end **58*b* and on either side of blade 58. Rollers 60 and 61 present mutually cooperating outer surfaces, and are moved angularly by an electric motor connected to roller 61**.

Blade type selector device 57 presents a substantially triangular cross section (FIG. 3), and is movable angularly between a first position (FIG. 2) wherein a tapered end portion 57a substantially contacts belt 47, and a second position (shown by the dotted line) wherein end portion 57a is detached from belt 47.

When set to said first position, selector device 57 intercepts the mail items on belt 47 and feeds them on to blade 58 from which they are fed by rollers 60 and 61 to the inputs 50 of respective accumulating units 11.

Figure 2:
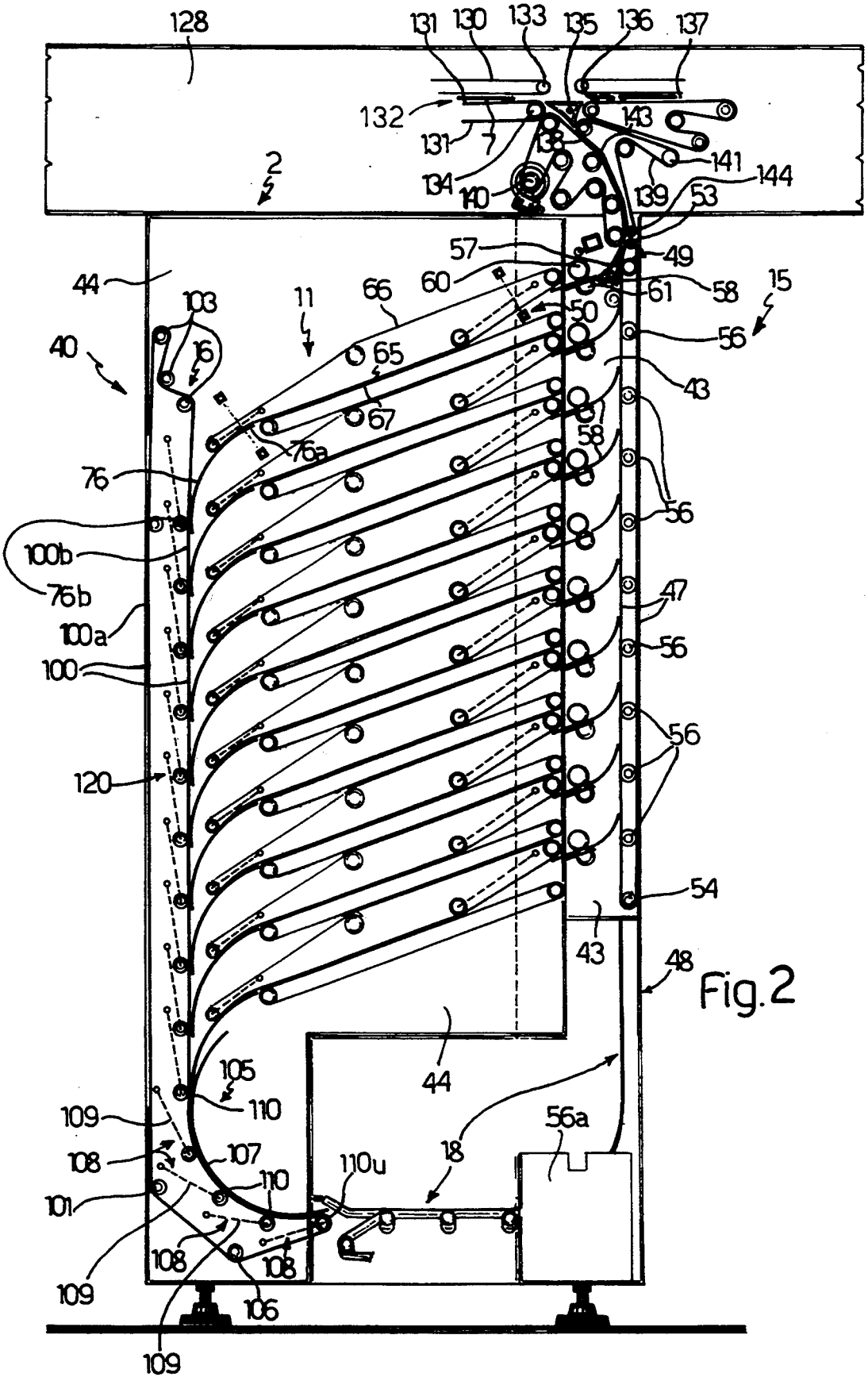
FIG. 2 shows a front view of an accumulating device in accordance with the teachings of the present invention.
Figure 3:
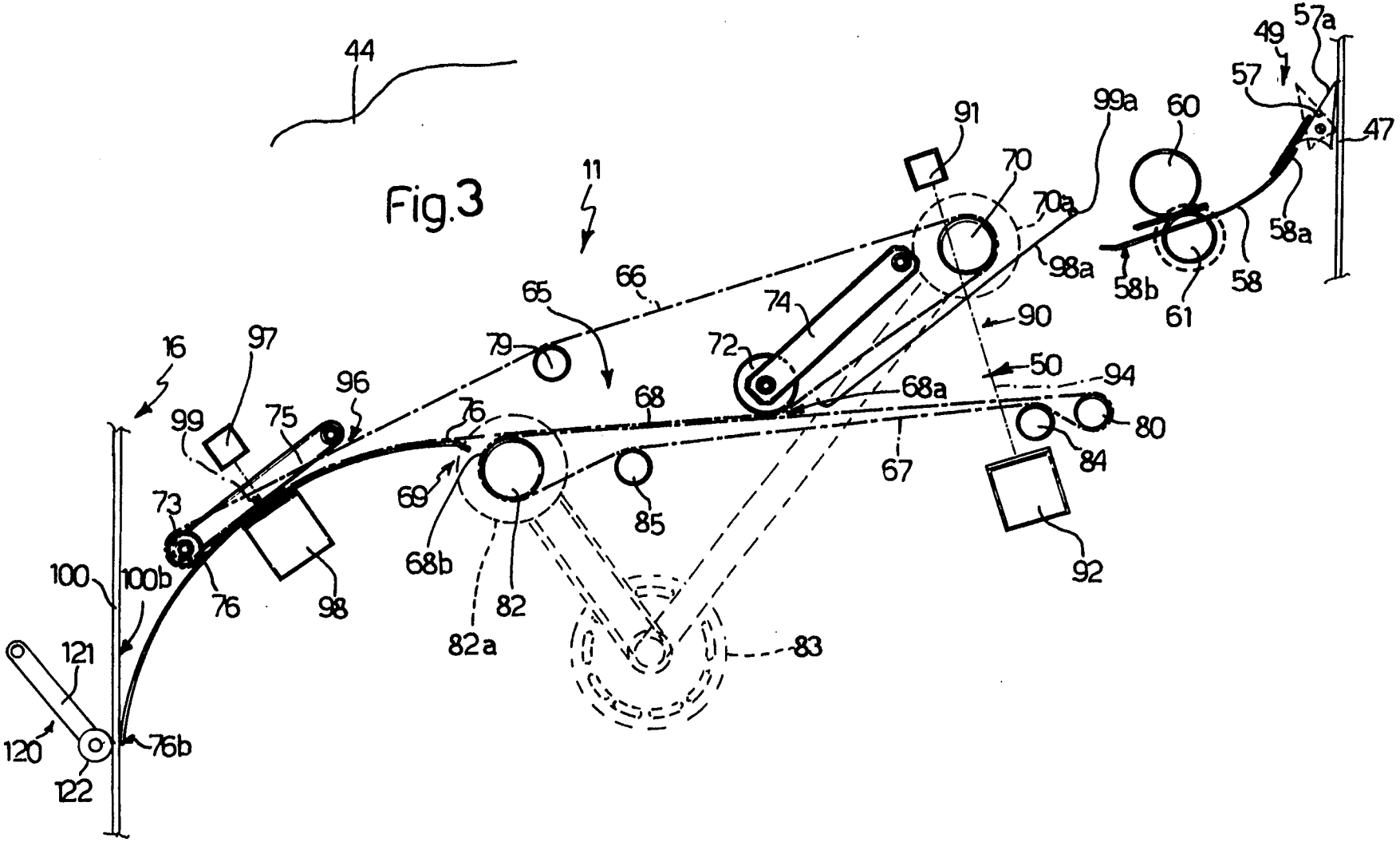
FIG. 3 shows a larger-scale front view of a detail of the FIG. 2 device.

As shown particularly in FIGS. 2 and 3, each accumulating unit 11 comprises a conveyor belt system 65 composed of a first belt 66 and a second belt 67 contacting each other along a substantially straight portion 68 extending between the point of contact **68*a* of belts 66, 67 constituting input 50, and the point of separation 68*b* of belts 66, 67 constituting the output 69 of unit 11**.

In particular, viewed from the top, the first belt 66 presents a substantially triangular perimeter, at the vertices of which are respectively located a top drive roller 70 fitted to plate 44, and two bottom pressure rollers 72 and 73 fitted to the first ends of respective straight arms 74, 75, the second ends of which are hinged to plate 43. Arms 74 and 75 are also connected to respective elastic devices (not shown) for pushing arms 74, 75 in the opposite direction to the elastic reaction of belt 66 and so tensioning belt 66. Roller 72 is located at the point of contact **68*a* of belts 66, 67, and belt 66 presents an internal tensioning roller 79 along the portion of the belt extending between rollers 73 and 70**.

The second belt 67 extends between a first internal idle roller 80 located beneath roller 70, and a second internal drive roller 82 located at the point of separation **68*b* of belts 66, 67 and adjacent to a first end 76*a* of a curved blade 76 having its convexity facing belt 66, and extending from end 76*a* to a bottom end 76*b* adjacent to collecting system 16. Blade 76 also presents a mid portion contacting the outer surface of belt 66 pressed by roller 73 towards blade 76**.

The second belt 67 also presents two external idle rollers 84 and 85 (not shown in FIG. 2 for the sake of simplicity) respectively located close to rollers 80 and 82 and which press on the outer surface of belt 67 for tensioning it.

Rollers 70 and 82 are mounted on the output shafts (not shown) of known brake-clutch devices **70*a* and 82*a*, which are input-connected to an electric d.c. motor 83 (shown schematically) and controlled by electronic unit 33**.

Each unit 11 also comprises a first optoelectronic sensor 90 composed of a photoemitting device 91 (e.g. a photodiode) adjacent to roller 70, and a photodetecting device 92 (e.g. a phototransistor) adjacent to roller 80, which devices define an optical path 94 (shown by the dotted line) extending close to the point of contact **68*a* of belts 66, 67 and which is interrupted by a mail item 7 entering unit 11**.

Each unit 11 also comprises a second optoelectronic sensor 96 composed of a photoemitting device 97 (e.g. a photodiode) and a photodetecting device 98 (e.g. a phototransistor), located on either side of blade 76 and defining an optical path 99 (indicated by the dotted line) which is interrupted by a mail item 7 leaving unit 11.

Each unit 11 (FIG. 3) also presents a guide device composed of an oscillating metal blade **98*a* extending from a point close to end 58*b* of blade 58 towards input 50. In particular, blade 98*a* presents a first end hinged to a pin 99*a* fitted perpendicularly to plate 43, and a second end resting on belt 67 close to point 68*a***.

As shown in FIG. 2, collecting and conveyor system 16 comprises a vertical belt 100 in turn comprising a first straight vertical up portion **100*a* adjacent and parallel to the vertical edge of supporting structure 40 and extending between a bottom roller 101 and three top rollers 103 by which belt 100 is guided downwards to form a second straight vertical down portion 100b contacting the second ends 76*b* of blades 76 of all of units 11. The second straight portion 100*b* extends from rollers 103 to an output device 105 where belt 100 joins up with external conveyor system 18 and is directed towards a roller 106 and from there to roller 101**.

Output device 105 comprises a curved blade 107 fitted to a bottom portion of plate 44, with its convexity facing belt 100 and four pressure devices 108 for pushing belt 100 towards blade 107. Each pressure device 108 comprises an arm 109 having a first end hinged to plate 43, and a second end supporting a roller 110 for pressing on the inner surface of belt 100 and so pushing it towards blade 107.

On reaching the end of blade 107, belt 100 departs from blade 107 by winding roughly 360° about a roller **110*u*, so that the point of departure of belt 100 about roller 110*u* forms the output of conveyor system 16 adjacent to and communicating with the input of external conveyor system 18**.

Belt 100 also presents ten vertically aligned, equally spaced tensioning devices 120 located inside the perimeter defined by belt 100. Each tensioning device 120 comprises an arm 121 having a first end hinged to plate 44, and a second end supporting a roller 122 which is pressed by an elastic device (not shown) on to the inner surface of belt 100 and towards a respective end **76*b* of blade 76**.

FIG. 2 also shows a detailed representation of a portion of conveyor belt system 9 and input 4 of device 2. In particular, the portion shown of conveyor belt system 9 is mounted on a rectangular plate 128 adjacent to a top portion of supporting structure 40 of device 2, and comprises a first and second belt 130, 131 extending substantially parallel and adjacent to each other along a first inflow portion 132 (of which only the end portion is shown) originating at postal machine 10 and terminating upon separation of belts 130, 131 about respective rollers 133, 134.

The output of portion 132 faces a switch device composed of a known blade type selector 135 movable angularly by an actuator (not shown), having a substantially triangular cross section, and which provides for feeding mail items 7 to input 4 or to input 136 of a second portion 137 of conveyor system 9 traveling towards the next accumulating device 2.

Input 4 is formed by the union of a first and second belt 138, 139 activated by respective rollers 140, 141 and contacting each other along a path 143 extending between input 4 and an output 144 at which belts 138, 139 are separated, and which is located facing roller 53 so that items 7 traveling along path 143 are transferred to conveyor belt 47.

The postal machine described comprises two accumulating devices 2a, 2b, and conveniently presents one switch device 135 located along conveyor system 9, for feeding inputs 4a, 4b. Should machine 1 comprise a greater number of parallel-connected accumulating devices, conveyor system 9 is conveniently provided with an adequate number of switch devices for feeding the respective inputs of the accumulating devices.

In actual use, mail items 7 are packed inside machine 10 from which they are separated and fed to reading unit 29 which provides in known manner for reading a code (e.g. a bar or postal code) impressed on each item 7. The code reading enables the performance in known manner of a first sorting cycle of items 7, wherein electronic unit 33 enables switches 135 and selector devices 57 so as to feed items 7 into accumulating devices 2a, 2b and into the various accumulating units 11 designed to house items 7 with similar or identical codes.

Items 7 are thus fed along path 143 to devices 2a, 2b and on to conveyor belt 47 of conveyor system 15.

Conveyor belt 47 feeds items 7 to the first switch device 49 where, depending on the position of selector 57, they are fed either into the adjacent accumulating unit 11 or to the next switch device 49 where the above switch operation is repeated. In the event item 7 is fed into none of accumulating units 11 (e.g. through lack of a code or because the code is illegible), it is fed to the bottom end of conveyor belt 47 and collected in container 56a.

On being fed into accumulating unit 11, item 7 slides along a lateral wall of selector 57 and along blade 58 to rollers 60, 61 by which it is gripped and fed into input 50 along a path which intersects optical path 94 and terminates upon the leading edge of item 7 contacting blade 98a. This directs item 7 on to belt 67 so that the leading edge of item 7 is inserted between belts 66 and 67, and a small portion of item 7 is fed beneath pressure roller 72. The crossing of optical path 94 is detected by electronic unit 33 which activates brake-clutch devices 70a and 82a, so that rollers 70 and 82 rotate at substantially constant speed for a given time T1, and belts 66 and 67, traveling at constant speed in the same direction, are shifted a given distance S of, say, 5 mm.

As such, the first item 7 fed into unit 11 is inserted between belts 66 and 67 and shifted by distance S towards the output 69 of conveyor system 65.

When the next item 7 is fed into unit 11, the above operations are repeated, so that the first item 7, already inserted between belts 66 and 67, is moved further towards output 69, and the second item 7 is superimposed on the first, with its leading edge separated from that of the first item 7 by a distance substantially equal to S (5 mm). The above operations are repeated for all the items 7 fed into unit 11, so that conveyor system 65 eventually contains a group (not shown) of overlapping items 7 aligned along portion 68, which group gets longer and moves further towards output 69 of conveyor system 65 as further items 7 are fed into unit 11. When the leading edge of the first item 7 fed into unit 11 intersects optical path 99, a command is issued for unloading unit 11, brake-clutch devices 70a, 82a are activated for a given time T2 (greater than T1), and belts 66, 67 are so operated as to feed the whole of group between belt 66 and blade 76 and on to belt 100. Belts 66, 67 are operated at constant speed so as to preserve the relative position and spacing of overlapping items 7 as group is transferred.

Items 7 unloaded from unit 11 are then transferred by belt 100 to external conveyor system 18 which is of such a length as to accommodate all ten groups of items 7 unloaded from units 11 and arranged adjacent to one another along an output path defined by adjacent belt portions (not shown) defining external conveyor system 18.

At the output of external conveyor system 18, items 7 may be fed either to end processing device 25 or back to conveyor system 9 for a further sorting cycle.

The accumulating device described thus clearly provides for overcoming the drawbacks typically associated with known devices.

For each unit 11, device 2 provides for accumulating an extremely large number of items 7 per unit length; and, by virtue of items 7 being overlapped and housed in conveyor system 65 communicating directly with belt 100, units 11 are unloaded extremely rapidly and at any rate in far less time than that required for unloading manually or automatically by means of a robot.

Moreover, conveyor system 18 of device 2 is capable of accommodating all the items 7 contained in units 11, so that all the items 7 unloaded from all of units 11 may be processed directly.

By virtue of the structure described above of accumulating units 11, device 2 is extremely compact and readily installable in confined spaces (e.g. suburban post offices).

To those skilled in the art it will be clear that changes may be made to the accumulating device as described and illustrated herein without, however, departing from the scope of the present invention.

For example, each device 2 may present a number of accumulating units other than as described, e.g. more than two or at any rate other than ten; and changes may be made to the design and arrangement of belts 66, 67.

Sensor 90 may be replaced by a sensor (not shown) for detecting the thickness of group of overlapping items 7, and generating a signal for enabling brake-clutch devices 70a, 82a upon the detected thickness exceeding a given maximum value.

We claim:

1. A mail accumulating device comprising:

a) at least two accumulating units aligned in a vertical plane, each of said units having an input to receive mail items within said unit and an output to discharge mail items therefrom;

b) first conveyor system adapted to selectively deposit mail items within said accumulating units;

c) second conveyor system adapted to convey deposited mail items from said accumulating units;

d) each of said accumulating units provided with conveyor means operatively associated with a drive means for laterally advancing mail items along a path within said unit from said input to said respective output; and e) first sensor means operatively associated with each of said accumulating units for detecting entry of mail items into said units and generating a first enabling signal in response thereto to actuate said drive means and cause advancement of said respective conveyor means for a discrete increment from said imput to said output whereby the mail items are deposited in said accumulating units so as to overlap in sequential order and on said respective conveyor means.

2. A mail accumulating device as in claim 1 and wherein:

a) said conveyor means comprising first and second carrying belts operatively associated with said drive means, said belts contacting each other along said path, said path extending between said input to said output;

b) said belts movable in the same direction and in discrete increments from said input to said output upon actuation of said drive means by said enabling signal.

3. A mail accumulating device as in claim 2 and wherein:

a) said first belt is an endless belt having a substantially triangular cross-sectional shape the vertices of which are provided with respective rollers, one of which is a drive roller;

b) said second belt is an endless belt extending between a pair of rollers one of which is a drive roller.

4. A mail accumulating device as in claim 17 and wherein:

a) said first sensor means positioned adjacent said input of said accumulating units.

5. A mail accumulating device as in claim 1 and further comprising:

a) second sensor means operatively associated with said accumulator units for detecting a pre-determined profile of mail items in said unit and generating a second signal to advance said conveyor means continuously for a period of time whereby the group of mail items deposited in said accumulating unit are transferred from said accumulating unit to said second conveyor system.

6. A mail accumulating device as in claim 5 and wherein:

a) said second sensor means operatively associated with said accumulating unit output to detect a first mail item of said group advanced along said conveyor means to said output and a last mail item of said group advanced along said conveyor means to said output.

7. A mail accumulating device as in claim 1 and wherein:

a) said second conveyor system having a suitable length to accommodate all the deposited groups of mail items from said accumulating units with the mail items arranged adjacent each other on an output path defined by said second conveyor system.

8. A mail accumulating device as in claim 1 and wherein:

a) said first conveyor system and said second conveyor system including belt conveyor devices to convey the mail items.

9. A mail accumulating device as in claim 5 and wherein:

a) said first and second sensor means comprising optoelectronic sensors including a photoemitting device and cooperating photodetecting device defining an optical path intersected by said mail item path.

10. A mail accumulating device as in claim 2 and wherein:

a) said first conveyor system including a conveyor belt defining a conveying path that intersects each of said inputs of said accumulating units; and b) switch devices positioned between said conveyor belt and each of said accumulating unit inputs and operatively associated therewith to selectively divert a mail item traveling on said first conveyor system conveying path and into said accumulating unit.

11. A mail accumulating device as in claim 10 and wherein:

a) said switch devices each comprising a blade type selector of substantially triangular cross-section and having a tapered end portion movable between a first position wherein said end portion substantially contacts said conveyor belt and a second position wherein said end portion is disposed away from said conveyor belt.

12. A mail accumulating device as in claim 10 and wherein:

a) said second conveyor system including a vertical conveyor belt defining a conveyor path that intersects each of said outputs of said accumulating units to receive mail items discharged from said accumulating units.

13. A mail accumulating device as in claim 12 and further comprising:

a) fixed blade device having a convex shape extending from a first end to a second end, said blade device positioned between each of said outputs and said vertical conveyor belt for transferring discharged mail items from said accumulating units to said conveyor path, the convex portion of said fixed blade device facing said first carrying belt of each of said accumulating units, said fixed blade device first end adjacent said output and said fixed blade device second end adjacent said second vertical conveying belt.

14. A postal machine comprising:

a) at least one loading unit for storing a number of mail items to be sorted;

b) a reading unit for reading a code on each of the mail items;

c) an accumulating device for sorting mail items in accordance with the code thereon said accumulating device comprising at least two accumulating units aligned in a vertical plane, each of said units having an input to receive mail items within said unit and an output to discharge mail items therefrom, first conveyor system adapted to deposit mail items within said accumulating units, once the mail item code has been read, second conveyor system adapted to convey deposited mail items from said accumulating units;

d) each of said accumulating units provided with conveyor means operatively associated with a drive means for laterally advancing mail items along a path within said unit from said input to said respective output and first sensor means operatively associated with each of said accumulating units for detecting entry of mail items into said unit and generating a first enabling signal in response thereto to actuate said drive means and cause advancement of said respective conveyor means for a discrete increment from said imput to said output whereby a group of mail items are deposited into said accumulating unit so as to overlap in sequential order on said respective conveyor means; and e) an end collecting unit for collecting sorted mail items removed from each of said accumulating units by said second conveyor system.

* * * * *